US010641259B2

(12) United States Patent
Kobayashi

(10) Patent No.: US 10,641,259 B2
(45) Date of Patent: May 5, 2020

(54) SEALED COMPRESSOR AND REFRIGERATION DEVICE

(71) Applicant: PANASONIC APPLIANCES REFRIGERATION DEVICES SINGAPORE, Singapore (SG)

(72) Inventor: Masanori Kobayashi, Shiga (JP)

(73) Assignee: PANASONIC APPLIANCES REFRIGERATION DEVICES SINAPORE, Singapore (SG)

( * ) Notice: Subject to any disclaimer, the term of this patent is extended or adjusted under 35 U.S.C. 154(b) by 444 days.

(21) Appl. No.: 14/779,472

(22) PCT Filed: Mar. 31, 2014

(86) PCT No.: PCT/JP2014/001887
§ 371 (c)(1),
(2) Date: Sep. 23, 2015

(87) PCT Pub. No.: WO2014/162727
PCT Pub. Date: Oct. 9, 2014

(65) Prior Publication Data

US 2016/0047368 A1 Feb. 18, 2016

(30) Foreign Application Priority Data

Apr. 1, 2013 (JP) ..... 2013-075617

(51) Int. Cl.
*F04B 35/04* (2006.01)
*F04B 39/12* (2006.01)
(Continued)

(52) U.S. Cl.
CPC ..... *F04B 35/04* (2013.01); *F04B 39/1066* (2013.01); *F04B 39/1073* (2013.01);
(Continued)

(58) Field of Classification Search
CPC ..... F04B 19/022; F04B 19/22; F04B 39/122; F04B 39/0016; F04B 7/02; F04B 7/0003;
(Continued)

(56) References Cited

U.S. PATENT DOCUMENTS 5,080,130 A 1/1992 Terwilliger et al.
2002/0146339 A1* 10/2002 Kaido ..... F04B 39/0005 417/562
(Continued)

FOREIGN PATENT DOCUMENTS

CN 1382910 12/2002
CN 201606234 10/2010
(Continued)

OTHER PUBLICATIONS

Office Action issued for Chinese application No. 201480019793.X, dated Aug. 9, 2016, 11 pages including English translation.
(Continued)

*Primary Examiner* — Devon C Kramer
*Assistant Examiner* — Christopher J Brunjes
(74) *Attorney, Agent, or Firm* — Hamre, Schumann, Mueller & Larson, P.C.

(57) ABSTRACT

In a sealed compressor (100) of the present invention, a valve plate (150) is provided with a plurality of discharge holes (151*a*, 151*b*) and a plurality of discharge valves (171*a*, 171*b*) which open and close the plurality of discharge holes. A tip end surface (160*a*) of a piston (160) is provided with a plurality of convex portions (161*a*, 161*b*), at least tip end portions of which are located inside of the discharge holes (151*a*, 151*b*) in a state in which the piston (160) is located at a top dead center. When a plurality of discharge passages (172*a*, 172*b*) of the refrigerant gas are defined as spaces formed between convex portion side surfaces (162*a*, 161*b*) and discharge hole inner peripheral surfaces (152*a*, 152*b*), in
(Continued)

a state in which the plurality of convex portions (161*a,* 161*b*) are located inside of the plurality of discharge holes (151*a,* 151*b*), respectively, the volumes of the plurality of convex portions (161*a,* 161*b*) are made different from each other, to make the total cross-sectional areas of the plurality of discharge passages (172*a,* 172*b*) different from each other.

4 Claims, 8 Drawing Sheets

(51) Int. Cl.
*F04B 39/10* (2006.01)
*F15B 15/22* (2006.01)
*F04B 53/10* (2006.01)

(52) U.S. Cl.
CPC ..... *F04B 39/121* (2013.01); *F04B 53/1047* (2013.01); *F15B 15/223* (2013.01)

(58) Field of Classification Search
CPC .. F04B 7/0208; F04B 7/04; F04B 3/00; F04B 13/00; F04B 53/148; F04B 35/04; F04B 39/121; F04B 39/1073; F04B 39/1066; F04B 53/1047; F04B 53/105; F04B 53/1085; F15B 15/223; F16K 39/04; Y10T 137/7859–7865
USPC ..... 417/251, 252, 256, 258–262, 289, 417/457–459, 490, 491, 525–527, 571, 417/327, 562, 520; 137/599.01, 601.01, 137/883, 565.11, 513.11, 23; 91/408, 409
See application file for complete search history.

(56) References Cited

U.S. PATENT DOCUMENTS

| | | | | |
|---|---|---|---|---|
| 2009/0116982 | A1* | 5/2009 | Tsuboi | F04B 39/0094 417/410.1 |
| 2009/0175746 | A1* | 7/2009 | Park | F04B 39/1066 417/520 |
| 2010/0316515 | A1* | 12/2010 | Hamada | F04B 39/023 417/437 |
| 2014/0169998 | A1* | 6/2014 | Kinjo | F04B 39/0005 417/415 |

FOREIGN PATENT DOCUMENTS

| | | |
|---|---|---|
| JP | 56-156479 | 12/1981 |
| JP | 62-147057 | 7/1987 |
| JP | 3-179181 | 8/1991 |
| JP | 2790504 B | 8/1998 |
| JP | 2011-132940 | 7/2011 |

OTHER PUBLICATIONS

International Search Report, dated Jun. 24, 2014, PCT/JP2014/001887, 2 pages.

* cited by examiner

SEALED COMPRESSOR AND REFRIGERATION DEVICE

TECHNICAL FIELD

The present invention relates to a sealed compressor for use in a refrigeration cycle of refrigeration devices or the like, and a refrigeration device using the sealed compressor.

BACKGROUND ART

Refrigeration devices including refrigeration cycles are widely used for household purposes or business purposes, as home electric freezers/refrigerators, air conditioners, show cases, and others. The refrigeration devices include sealed compressors for compressing a refrigerant gas. Also, it is known that air compressors for use in industries are the sealed compressors. In recent years, there has been an increasing demand for global environment conservation. Under the circumstances, there has been a strong demand for the high efficiency of the sealed compressors. Further, a demand for reduction of a noise has been increasing.

Conventionally, to realize the higher efficiency of the sealed compressor and the reduction of the noise in the sealed compressor, a technique in which a plurality of discharge holes are provided to discharge the refrigerant gas from a compression chamber. For example, as shown in FIG. 7, Patent Literature 1 discloses a valve plate 550A provided with two discharge outlets 551*a*, 551*b* (discharge holes) and one suction inlet 555. The discharge outlets 551*a*, 551*b* are equal in diameter. Trepanning seal sections 554*a*, 554*b* (valve seat seal sections) which are different in diameter are provided around the discharge outlets 551*a*, 551*b*, respectively. These discharge outlets 551 are covered by valve reeds (discharge valves), respectively, which are not shown.

In this configuration, the two discharge outlets 551*a*, 551*b* which are equal in diameter can increase the total area of the discharge holes. This makes it possible to reduce a resistance generated when the refrigerant gas is discharged from the interior of a compression chamber through the discharge outlets 551. Therefore, the excess compression loss of the discharged refrigerant gas can be reduced. As a result, the high efficiency of the sealed compressor can be realized.

A force applied by the refrigerant gas to push up the valve reeds is proportional to the area of the trepanning seal sections 554*a*, 554*b*. Since the trepanning seal sections 554*a*, 554*b* are different in diameter from each other, this causes a difference between the push-up forces in the discharge outlets 551*a*, 551*b* which are equal in diameter. This also causes a difference between the timings when the valve reeds start to open, and hence a difference between the timings when the valve reeds are closed. Due to the differences, the valve reeds collide against the corresponding trepanning seal sections 554*a*, 554*b* at different timings, and thus the impact forces generated due to the collision of the valve reeds against the corresponding trepanning seal sections 554*a*, 554*b* can be reduced in magnitude. As a result, a noise can be mitigated.

As shown in FIG. 8, Patent Literature 2 discloses a valve plate 550B provided with two discharge holes 551*c*, 551*d*. The valve plate 550B is provided with discharge valve reeds (not shown) on a surface thereof which is away from a compression chamber 534. The tip end surface of a piston 560 (end surface which is closer to the valve plate 550B) is provided with projections 561*c*, 561*d* to correspond in position to the discharge holes 551*c*, 551*d*, respectively. As shown in FIG. 8, when the piston 560 is located at a top dead center, the two discharge holes 551*c*, 551*d* are closed by the two projections 561*c*, 561*d*, respectively.

In this configuration, since the projections 561*c*, 561*d* move into the discharge holes 551*c*, 551*d*, respectively, it becomes possible to prevent a situation in which the refrigerant gas remains inside of the discharge holes 551*c*, 551*d*. Therefore, during a suction stroke, the re-expansion of the remaining refrigerant gas can be suppressed, and the volumetric efficiency can be increased. As a result, the efficiency of the sealed compressor can be increased.

CITATION LIST

Patent Literature

Patent Literature 1: Japanese Laid-Open Patent Application Publication No. Hei. 03-179181

Patent Literature 2: Japanese Laid-Open Patent Application Publication No. Sho. 62-147057

SUMMARY OF INVENTION

Technical Problem

However, in the valve plate 550A disclosed in Patent Literature 1, when the piston (not shown) is located at the top dead center, the refrigerant gas in a high-pressure state is not discharged through the discharge outlets 551*a*, 551*b* and tends to remain therein. In addition to the inside of the discharge outlets 551*a*, 551*b*, the high-pressure refrigerant gas tends to remain in the inner spaces of the trepanning seal sections 554*a*, 554*b*. For this reason, during a suction stroke, the volumetric efficiency is likely to be decreased due to the re-expansion of the remaining refrigerant gas. The increase in the efficiency which can be brought about by increasing the total area of the discharge holes is cancelled by the decrease in the volumetric efficiency, during the suction stroke. As a result, a sufficient increase in the efficiency cannot be obtained.

In the valve plate 550B and the piston 560 disclosed in Patent Literature 2, it becomes possible to prevent a situation in which the refrigerant gas remains inside of the discharge holes 551*c*, 551*d*, but it is impossible to prevent a situation in which the discharge valve reeds (not shown) collide against the trepanning seal sections, respectively, at the same time. Therefore, generation of the noise due to the collision of the discharge valve reeds against the trepanning seal sections cannot be effectively suppressed.

The present invention has been made to solve the above described problem, and an object of the present invention is to provide a sealed compressor which is capable of increasing a volumetric efficiency and reducing a noise.

Solution to Problem

To solve the above described problem, the present invention provides a sealed compressor comprising: a sealed container having a sealed space inside thereof; an electric component accommodated in the sealed container; and a compression component accommodated in the sealed container and driven by the electric component to compress a refrigerant gas, wherein the compression component includes: a cylinder block formed with a compression chamber inside thereof; a piston reciprocatingly inserted into the compression chamber through one end of the cylinder block; and a valve plate which closes the other end (opposite end) of the cylinder block, wherein the valve plate has a suction hole through which the refrigerant gas is suctioned into the compression chamber, and a plurality of discharge holes through which the refrigerant gas is discharged from an interior of the compression chamber, the valve plate being provided with a plurality of discharge valves which open and close the plurality of discharge holes, respectively, wherein the piston is provided with a plurality of convex portions on a tip end surface thereof, at least tip end portions of the plurality of convex portions being located inside of the plurality of discharge holes, respectively, in a state in which the piston is located at a top dead center, and wherein when a plurality of discharge passages of the refrigerant gas are defined as spaces formed between outer peripheral surfaces of the plurality of convex portions and inner peripheral surfaces of the plurality of discharge holes, respectively, in a state in which the plurality of convex portions are located inside of the plurality of discharge holes, respectively, passage areas of the plurality of discharge passages are made different from each other.

The passage areas of the plurality of discharge passages can be made different from each other, by making at least one of volumes of the plurality of convex portions, shapes of the plurality of convex portions, and sizes of the plurality of discharge holes, different from each other. The present invention also includes a refrigeration device comprising the sealed compressor having the above configuration.

The above and further objects, features and advantages of the present invention will more fully be apparent from the following detailed description of preferred embodiments with accompanying drawings.

Advantageous Effects of Invention

With the above described configuration, the present invention has an advantage that it is possible to provide a sealed compressor which is capable of increasing the volumetric efficiency and reducing a noise.

DESCRIPTION OF EMBODIMENTS

Figure 1:
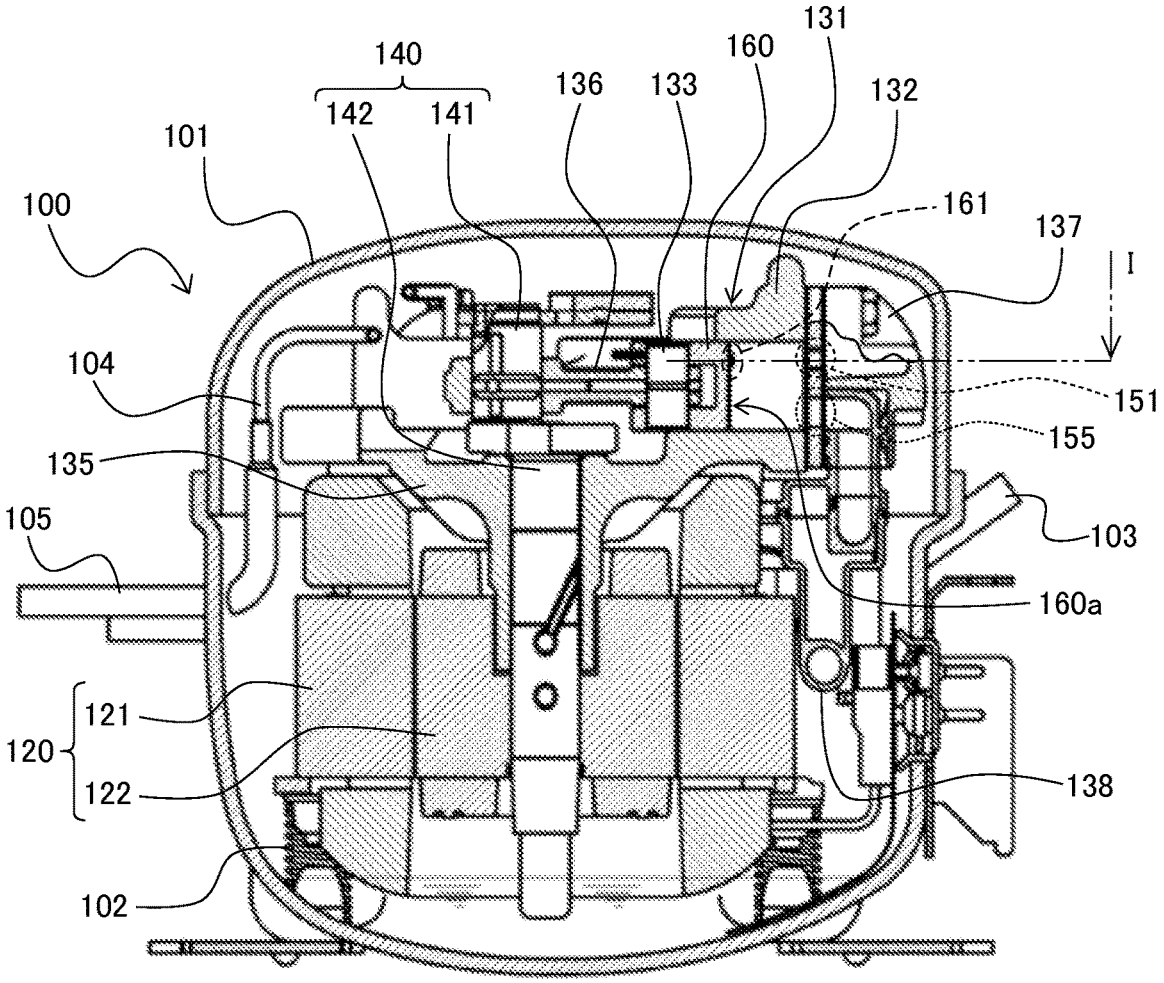
FIG. 1 is a longitudinal sectional view showing the exemplary configuration of a sealed compressor according to Embodiment 1 of the present invention.

A sealed compressor of the present invention comprises a sealed container having a sealed space inside thereof; an electric component accommodated in the sealed container; and a compression component accommodated in the sealed container and driven by the electric component to compress a refrigerant gas, wherein the compression component includes: a cylinder block formed with a compression chamber inside thereof; a piston reciprocatingly inserted into the compression chamber through one end of the cylinder block; and a valve plate which closes the other end of the cylinder block, wherein the valve plate has a suction hole through which the refrigerant gas is suctioned into the compression chamber, and a plurality of discharge holes through which the refrigerant gas is discharged from an interior of the compression chamber, the valve plate being provided with a plurality of discharge valves which open and close the plurality of discharge holes, respectively, wherein the piston is provided with a plurality of convex portions on a tip end surface thereof, at least tip end portions of the plurality of convex portions being located inside of the plurality of discharge holes, respectively, in a state in which the piston is located at a top dead center, and wherein when a plurality of discharge passages of the refrigerant gas are defined as spaces formed between outer peripheral surfaces of the plurality of convex portions and inner peripheral surfaces of the plurality of discharge holes, respectively, in a state in which the plurality of convex portions are located inside of the plurality of discharge holes, respectively, passage areas of the plurality of discharge passages are made different from each other.

In accordance with this configuration, when the refrigerant gas is discharged through the discharge holes in a state in which the piston is located at a top dead center during a compression stroke, the convex portions provided on the tip end surface of the piston pushes away the refrigerant gas out of the discharge holes. This makes it possible to prevent a situation in which the refrigerant gas remains inside of the discharge holes. Therefore, the re-expansion of the remaining refrigerant gas can be suppressed, and the volumetric efficiency can be improved, during a suction stroke.

In addition, since the passage areas of the plurality of discharge passages are made different from each other, the flow rates of the refrigerant gas discharged through the discharge holes can be made different from each other. This causes a difference between the degrees to which the discharge valves for opening and closing the discharge holes are opened, respectively, and hence a difference between the timings when the discharge valves are closed. Since the discharge valves collide against the valve seat seal sections, respectively, at different timings, the impact forces generated due to the collision of discharge valves collide against valve seat seal sections can be reduced in magnitude. As a result, a noise generated when the discharge valves are closed can be mitigated.

In the sealed compressor having the above configuration, the passage areas of the plurality of discharge passages may be made different from each other, by making at least one of volumes of the plurality of convex portions, shapes of the plurality of convex portions, and sizes of the plurality of discharge holes, different from each other.

In accordance with this configuration, the passage areas of the plurality of discharge passages can be made different from each other, by making the volumes of the plurality of convex portions, the shapes of the plurality of convex portions, or the sizes of the plurality of discharge holes, different from each other. Thus, it becomes possible to make the passage areas different from each other, with a simple configuration.

In the sealed compressor having the above configuration, when passage spacings are defined as spacings formed between the outer peripheral surfaces of the plurality of convex portions and the inner peripheral surfaces of the plurality of discharge holes in the plurality of discharge passages, the passage spacings of the plurality of discharge passages may be made uniform.

In accordance with this configuration, the passage spacings of the plurality of discharge passages are made uniform even though the passage areas of the plurality of discharge passages are made different from each other. Therefore, the flow rates of the refrigerant gas discharged from the discharge passages are made uniform. Since the flows of the refrigerant gas discharged through the discharge holes are faired in this way, the excess compression of the refrigerant gas can be suppressed during the discharge. As a result, the excess compression loss can be reduced, and thus an increase in an input (driving electric power) to the sealed compressor can be suppressed.

In the sealed compressor having the above configuration, each of the plurality of discharge holes may include a portion having an opening area increased from the compression chamber toward a discharge side.

In accordance with this configuration, since each of the plurality of discharge holes includes a portion having the opening area increased from the compression chamber toward the discharge side, the passage areas of the discharge passages are increased in the direction from the compression chamber toward the discharge side. The refrigerant gas discharged from the compression chamber is in a high-pressure state. When the high-pressure refrigerant gas is flowing through the discharge passages, passage resistances can be reduced. Thereby, the refrigerant gas can be discharged smoothly. As a result, the excess compression loss can be reduced, and an increase in the input can be suppressed.

In the sealed compressor having the above configuration, the electric component may be inverter-driven at one of a plurality of operating frequencies.

In accordance with this configuration, when the operating frequency is high, an increase in a noise can be suppressed, while when the operating frequency is low, reduction of the volumetric efficiency can be suppressed.

In a case where the electric component is driven at an operating frequency higher than a power supply frequency, the electric component rotates at a high speed. Therefore, the impact forces generated when the discharge valves are closed become great in magnitude. In accordance with this configuration, since the impact forces can be reduced in magnitude, by causing the collision of the discharge valves to occur at different timings, an increase in a noise can be suppressed during a high-speed rotation.

On the other hand, in a case where the electric component is driven at an operating frequency equal to or lower than the power supply frequency, the electric component rotates at a low speed. At this time, the amount of the refrigerant circulated is relatively small. If the refrigerant gas remains inside of the discharge holes, the effects of the re-expansion of the refrigerant gas produced during the suction stroke become significant. In accordance with the above configuration, since it becomes possible to prevent a situation in which the refrigerant gas remains inside of the discharge holes, the re-expansion of the refrigerant gas can be suppressed, and the reduction of the volumetric efficiency can be suppressed.

The present invention also includes a refrigeration device comprising the sealed compressor having the above configuration. Since the refrigeration device incorporates the sealed compressor capable of achieving high efficiency and mitigating a noise, electric power consumption in the refrigeration device can be reduced, and a noise generated in the refrigeration device can be mitigated.

Hereinafter, preferred embodiments of the present invention will be described with reference to the drawings. Throughout the drawings, the same or corresponding components are designated by the same reference symbols, and will not be described repeatedly.

Embodiment 1

Exemplary Configuration of Sealed Compressor

Figure 2:
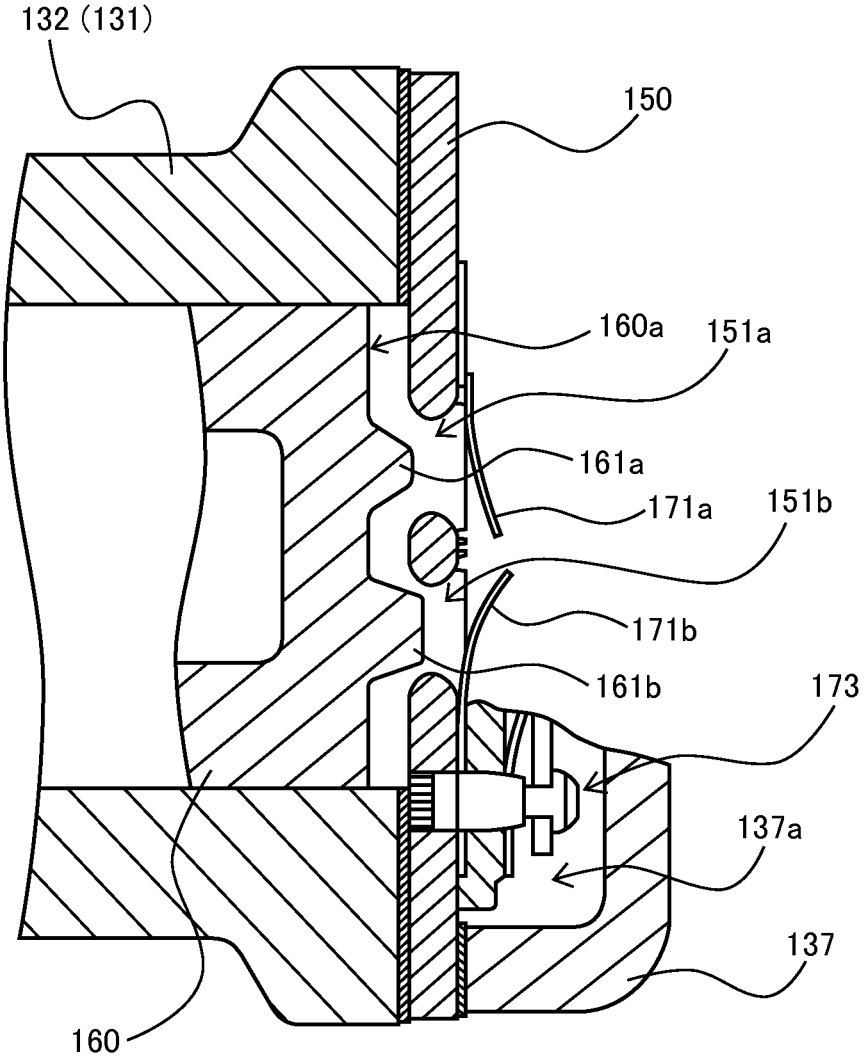
FIG. 2 is an enlarged partial cross-sectional view of a cylinder end portion, schematically showing the exemplary configurations of a valve plate and of a piston included in the sealed compressor of FIG. 1.
Figure 3:
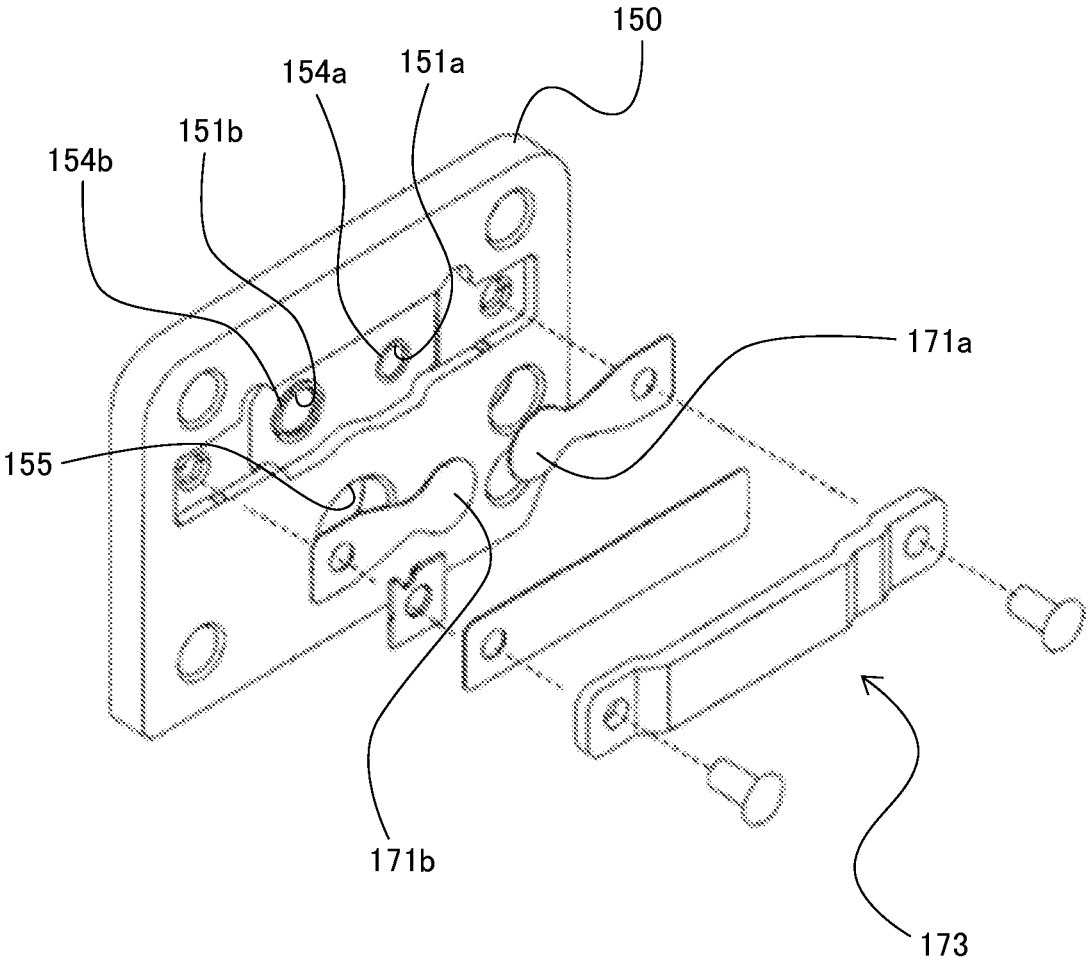
FIG. 3 is an exploded perspective view showing an example of the more specific configuration of the valve plate of FIG. 2.

Initially, the exemplary configuration of the sealed compressor according to Embodiment 1 will be described with reference to FIGS. 1 to 3. FIG. 2 is a partial cross-sectional view taken in the direction of an arrow indicated by a two-dotted line I of FIG. 1.

As shown in FIG. 1, a sealed compressor 100 according to the present embodiment includes an electric component 120 and a compression component 130 which are accommodated in a sealed container 101, and the sealed container 101 is filled with a refrigerant gas and lubricating oil. The electric component 120 and the compression component 130 constitute a compressor body. The compressor body is placed inside of the sealed container 101 such that the compressor body is elastically supported by a suspension spring 102 provided in the bottom portion of the sealed container 101.

The sealed container 101 is provided with a suction pipe 103, a discharge pipe 104, and an exit pipe 105. One end of the suction pipe 103 is in communication with the inner space of the sealed container 101, while the other end thereof is connected to a refrigeration device which is not shown, thus constituting a refrigeration cycle. One end of the discharge pipe 104 is connected to the compression component 130, while the other end thereof is connected to a refrigeration device (not shown) via the exit pipe 105. As will be described later, the refrigerant gas compressed by the compression component 130 is guided to the refrigeration cycle through the discharge pipe 104 and then the exit pipe 105, and the refrigerant gas delivered from the refrigeration cycle is guided to the inner space of the sealed container 101 via the suction pipe 103.

The refrigerant gas is filled in the sealed container 101 under a pressure equal to a pressure at a lower-pressure side in the refrigeration cycle into which the sealed compressor 100 is incorporated, and in a relatively low temperature state. The kind of the refrigerant gas is not particularly limited, and a gas known in the field of the refrigeration cycle is suitably used. In the present embodiment, for example, hydrocarbon-based refrigerant gas such as R600a is suitably used.

As shown in FIG. 1, the electric component 120 includes at least a stator 121 and a rotor 122. The stator 121 is fastened to the lower side of a cylinder block 131 (which will be described later) included in the compression component 130. The rotor 122 is placed coaxially with the stator 121 in a location inward of the stator 121. A main shaft 142 of a crankshaft 140 (which will be described later) included in the compression component 130, is fastened to the rotor 122, by, for example, shrink-fitting. The electric component 120 is connected to an external inverter driving circuit (not shown) and inverter-driven at one of a plurality of operating frequencies.

The compression component 130 is driven by the electric component 120 and compresses the refrigerant gas. As shown in FIG. 1, the compression component 130 includes the cylinder block 131, a piston 160, a cylinder 132, a compression chamber 134, a bearing section 135, a coupling section 136, the crankshaft 140, a valve plate 150, a cylinder head 137, a suction muffler 138, and others.

The cylinder block 131 is provided with the cylinder 132 and the bearing section 135. When a vertical direction is a longitudinal direction and a horizontal direction is a lateral direction, in a state in which the sealed compressor 100 is placed on a horizontal plane, the cylinder 132 is placed along the lateral direction and fastened to the bearing section 135 in the interior of the sealed container 101. The cylinder 132 is formed with a bore of a substantially cylindrical shape with a diameter substantially equal to that of the piston 160. The piston 160 is inserted into the cylinder 132 such that the piston 160 is reciprocatingly slidable. The cylinder 132 and the piston 160 define the compression chamber 134, and the refrigerant gas is compressed in the interior of the compression chamber 134. The bearing section 135 supports the main shaft 142 of the crankshaft 140 such that the main shaft 142 is rotatable.

The crankshaft 140 is supported in the interior of the sealed container 101 in such a manner that its axis extends in the longitudinal direction. The crankshaft 140 includes the main shaft 142, an eccentric shaft 141, and others. As described above, the main shaft 142 is fastened to the rotor 122 of the electric component 120. The eccentric shaft 141 is configured to be eccentric with respect to the main shaft 142. In this configuration, the rotational motion of the electric component 120 is converted into a reciprocation motion, which is transmitted to the piston 160. An oil feeding mechanism feeds the lubricating oil to the crankshaft 140.

The piston 160 inserted into the cylinder 132 is coupled to the coupling section 136. The piston 160 is placed such that its axis crosses the axial direction of the crankshaft 140. In the present embodiment, the crankshaft 140 is placed such that its center axis extends in the longitudinal direction, while the piston 160 is placed such that its center axis extends in the lateral direction. Therefore, the axial direction of the piston 160 is perpendicular to the axial direction of the crankshaft 140. The coupling section 136 is coupled to the piston 160 and to the eccentric shaft 141 of the crankshaft 140. The coupling section 136 transmits the rotational motion of the crankshaft 140 rotated by the electric component 120 to the piston 160, and thereby the piston 160 reciprocates in the interior of the cylinder 132.

As described above, the piston 160 is inserted into one end portion (closer to the crankshaft 140) of the cylinder 132. The other end portion (end portion which is away from the crankshaft 140) of the cylinder 132 is closed by the valve plate 150 and the cylinder head 137. The cylinder head 137 is fastened together with the valve plate 150 to the cylinder 132. The valve plate 150 is placed between the cylinder 132 and the cylinder head 137. The valve plate 150 is provided with one suction hole 155 and a plurality of discharge holes. In the present embodiment, as shown in FIGS. 2 and 3, the plurality of discharge holes are a first discharge hole 151*a* and a second discharge hole 151*b*.

A suction muffler 138 and the compression chamber 134 are in communication with each other via the suction hole 155. The valve plate 150 is provided with a suction valve (not shown) which opens and closes the suction hole 155, on a surface which is closer to the compression chamber 134. The suction hole 155 is configured to be opened and closed by this suction valve. The refrigerant gas is suctioned from the suction muffler 138 into the compression chamber 134 through the suction hole 155, when the suction valve is opened.

The cylinder head 137 and the compression chamber 134 are in communication with each other via the first discharge hole 151*a* and the second discharge hole 151*b*. As shown in FIGS. 2 and 3, the first discharge hole 151*a* and the second discharge hole 151*b* are opened and closed by a first discharge valve 171*a* and a second discharge valve 171*b*, respectively. As shown in FIG. 3, a first valve seat seal section 154*a* and a second valve seat seal section 154*b* are provided around the first discharge hole 151*a* and the second discharge hole 151*b*, respectively. The first discharge valve 171*a* and the second discharge valve 171*b* contact the first valve seat seal section 154*a* and the second valve seat seal section 154*b*, respectively, thereby closing the first discharge hole 151*a* and the second discharge hole 151*b*, respectively. The first discharge valve 171*a* and the second discharge valve 171*b* are mounted to the valve plate 150 by use of a known discharge valve mounting member 173.

As shown in FIG. 2, a first convex portion 161*a* and a second convex portion 161*b* are provided on a tip end surface 160*a* (surface closer to the valve plate 150) of the piston 160, to correspond in position to the first discharge hole 151*a* and the second discharge hole 151*b*, respectively. The first convex portion 161*a* and the second convex portion 161*b* are integrated with the tip end surface 160*a* of the piston 160. The specific configuration of the first convex portion 161*a* and the second convex portion 161*b* is not particularly limited. The first convex portion 161*a* and the second convex portion 161*b* may be manufactured as a part of the piston 160 in manufacturing of the piston 160. Or, the first convex portion 161*a* and the second convex portion 161*b* may be mechanically fastened to the piston 160 later. At least the tip end portion of the first convex portion 161*a* and the tip end portion of the second convex portion 161*b* are located inside of the first discharge hole 151*a* and inside of the second discharge hole 151*b*, respectively, when the piston 160 is located at a top dead center.

In other words, when the piston 160 reciprocating reaches the top dead center, the first convex portion 161*a* and the second convex portion 161*b* are fitted into the first discharge hole 151*a* and the second discharge hole 151*b*, respectively. When the piston 160 reaches the top dead center, the first convex portion 161*a* and the second convex portion 161*b* emerge inside of the first discharge hole 151*a* and inside of the second discharge hole 151*b*, respectively. As the piston 160 moves from the top dead center toward a bottom dead center, the first convex portion 161*a* and the second convex portion 161*b* move out of the first discharge hole 151*a* and the second discharge hole 151*b*, respectively. In this state, nothing is inserted into the first discharge hole 151*a* and the second discharge hole 151*b*.

The specific shape of the first convex portion 161*a* and the specific shape of the second convex portion 161*b* are not particularly limited, and may be a truncated-cone shape, as shown in FIG. 2. The first convex portion 161*a* and the second convex portion 161*b* having such a shape can move (be inserted) into and out of the first discharge hole 151*a* and the second discharge hole 151*b*, respectively. The size of the first convex portion 161*a* and the size of the second convex portion 161*b* are not particularly limited, and may be such that the first convex portion 161*a* and the second convex portion 161*b* can be inserted into the first discharge hole 151*a* and the second discharge hole 151*b*, respectively, namely, the inner diameter of the first convex portion 161*a* and the inner diameter of the second convex portion 161*b* are equal to or smaller than the inner diameter of the first discharge hole 151*a* and the inner diameter of the second discharge hole 151*b*, respectively.

In the present invention, the first convex portion 161*a* and the second convex portion 161*b* are different in volume from each other. In the present embodiment, as schematically shown in FIG. 2, the second convex portion 161*b* has a volume larger than that of the first convex portion 161*a*. A correspondence between the first discharge hole 151*a* and the first convex portion 161*a*, and a correspondence between the second discharge hole 151*b* and the second convex portion 161*b* will be described later.

A discharge chamber 137*a* is formed inside of the cylinder head 137. The refrigerant gas is discharged from the compression chamber 134 into the discharge chamber 137*a* through the first discharge hole 151*a* and the second discharge hole 151*b*. Since the cylinder head 137 is coupled to the discharge pipe 104, the discharge chamber 137*a* is in communication with the exit pipe 105 via the discharge pipe 104.

When viewed from the cylinder 132 and the cylinder head 137, the suction muffler 138 is located at a lower side in the interior of the sealed container 101. The interior of the suction muffler 138 is a muffling space, and is in communication with the compression chamber 134 via the suction hole 155 of the valve plate 150. In this structure, the refrigerant gas in the suction muffler 138 is guided to the interior of the compression chamber 134 via the suction hole 155.

Operation of Sealed Compressor

Next, the operation and functions of the sealed compressor 100 configured as described above will be specifically described. Although not shown in FIGS. 1 to 3, the sealed compressor 100 is incorporated into the refrigeration cycle in such a manner that the suction pipe 103 and the exit pipe 105 are connected to the refrigeration device having a well-known configuration.

Initially, when the electric component 120 is applied with a current from an external electric power supply, the current flows through the stator 121, to generate a magnetic field, causing the rotor 122 to rotate. According to the rotation of the rotor 122, the main shaft 142 of the crankshaft 140 rotates, and then the rotational motion of the main shaft 142 is transmitted to the piston 160 via the eccentric shaft 141 and the coupling section 136. The piston 160 reciprocates in the interior of the cylinder 132. According to the reciprocation motion of the piston 160, the refrigerant gas is suctioned, compressed and discharged in the interior of the compression chamber 134.

In the present embodiment, of the direction in which the piston 160 moves in the interior of the cylinder 132, a direction in which the volume of the compression chamber 134 increases (direction from the top dead center toward the bottom dead center) will be referred to as "increase direction" and a direction in which the volume of the compression chamber 134 decreases (direction from the bottom dead center toward the top dead center) will be referred to as "decrease direction". When the piston 160 moves in the increase direction, the refrigerant gas in the interior of the compression chamber 134 expands. When a pressure in the interior of the compression chamber 134 falls below a suction pressure, the suction valve starts to open due to a difference between the pressure in the interior of the compression chamber 134 and the pressure in the interior of the suction muffler 138.

According to this operation, the low-temperature refrigerant gas which has returned from the refrigeration device is released to the inner space of the sealed container 101 from the suction pipe 103. Then, the refrigerant gas is introduced to the interior of the suction muffler 138. At this time, since the suction valve starts to open as described above, the introduced refrigerant gas flows into the compression chamber 134. Thus, in a suction stroke, the piston 160 moves in the increase direction and the refrigerant gas is suctioned into the compression chamber 134.

Then, when the piston 160 moves in the decrease direction from the bottom dead center in the interior of the cylinder 132, the refrigerant gas in the interior of the compression chamber 134 is compressed, and the pressure in the interior of the compression chamber 134 increases. In addition, due to a difference between the pressure in the interior of the compression chamber 134 and the pressure in the interior of the suction muffler 138, the suction valve is closed. Thus, in a compression stroke, the piston 160 moves in the decrease direction, and the refrigerant gas is compressed in the compression chamber 134.

Then, when the pressure in the interior of the compression chamber 134 exceeds the pressure in the interior of the discharge chamber 137*a*, the first discharge valve 171*a* and the second discharge valve 171*b* start to open, due to a difference between the pressure in the interior of the compression chamber 134 and the pressure in the interior of the discharge chamber 137*a*. According to this operation, during a period that passes until the piston 160 reaches the top dead center in the interior of the cylinder 132, the compressed refrigerant gas is discharged to the discharge chamber 137*a* inside of the cylinder head 137, through the first discharge hole 151*a* and the second discharge hole 151*b*. The refrigerant gas discharged to the discharge chamber 137*a* is sent out to the refrigeration device via the discharge pipe 104 and the exit pipe 105. Thus, in the compression stroke, the refrigerant gas compressed in the compression chamber 134 is discharged to the discharge chamber 137*a*.

After that, when the piston 160 moves again in the increase direction from the top dead center in the interior of the cylinder 132, the refrigerant gas in the interior of the compression chamber 134 expands, so that the pressure in the interior of the compression chamber 134 decreases. When the pressure in the interior of the compression chamber 134 falls below the pressure in the interior of the discharge chamber 137*a*, the discharge valve is closed.

The above described suction stroke, compression stroke and discharge stroke are repeatedly performed in every rotation of the crankshaft 140, and thus the refrigerant gas is circulated within the refrigeration cycle.

Correspondences Between Discharge Holes and Convex Portions

Next, a correspondence between the first discharge hole 151*a* and the first convex portion 161*a*, and a correspondence between the second discharge hole 151*b* and the second convex portion 161*b*, will be described specifically with references to FIGS. 4 and 5. For easier explanation, the correspondence between a desired discharge hole and the corresponding convex portion will be referred to as "discharge hole-convex portion relation". Therefore, the correspondence between the first discharge hole 151*a* and the first convex portion 161*a* will be referred to as "first discharge hole-convex portion relation", while the correspondence between the second discharge hole 151*b* and the second convex portion 161*b* will be referred to as "second discharge hole-convex portion relation." To describe the discharge hole-convex portion relation more specifically, in FIG. 4, the first discharge hole-convex portion relation will be described as a representative. The same basically applies to the second discharge hole-convex portion relation, although this will not described.

Figure 4:
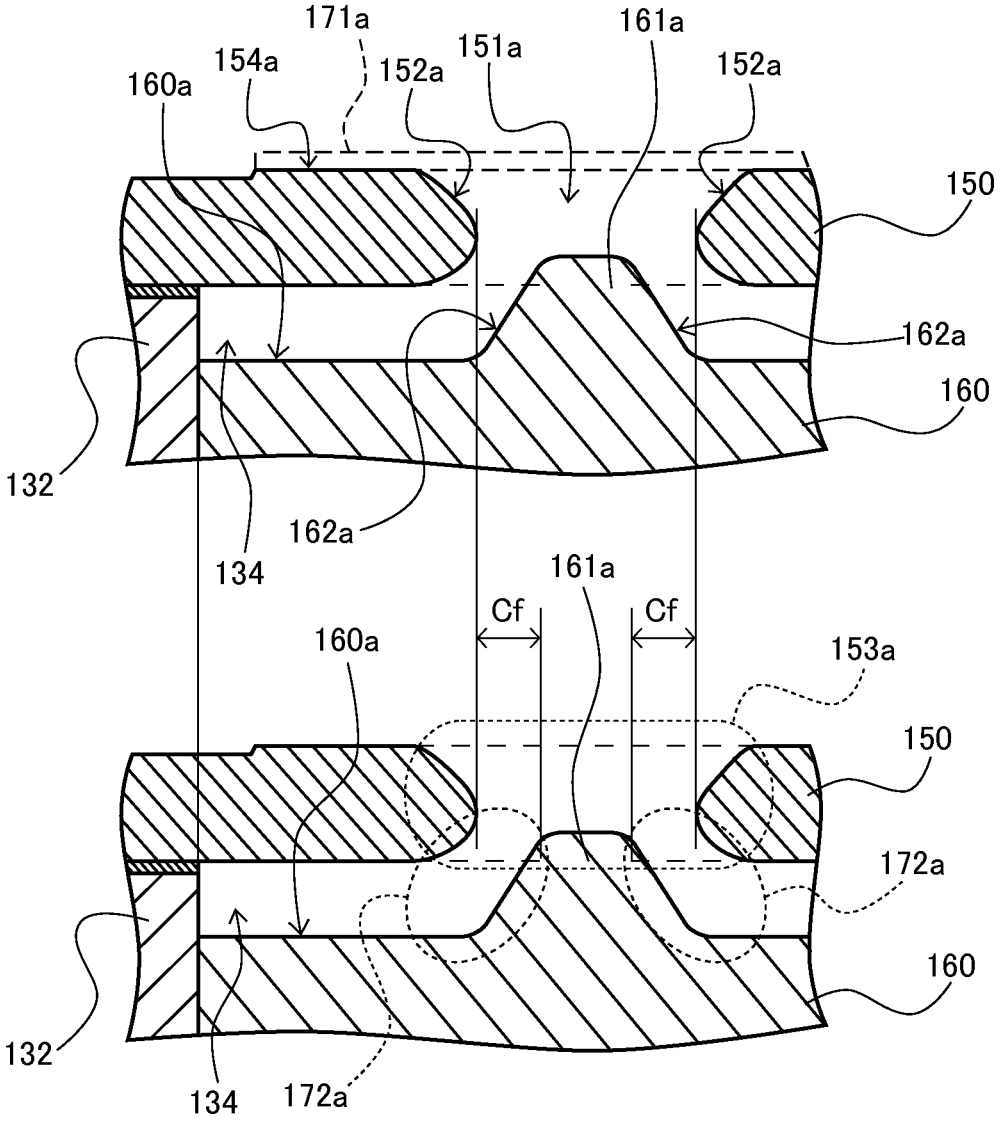
FIG. 4 is a schematic cross-sectional view showing correspondences between discharge holes provided in the valve plate of FIG. 2 and convex portions provided on the piston of FIG. 2.

As shown in FIG. 4, the first discharge hole 151*a* is provided in the valve plate 150. As described above, through the first discharge hole 151*a*, the refrigerant gas is discharged from the compression chamber 134 to the discharge chamber 137*a* (not shown in FIG. 4). As described above, the first discharge hole 151*a* is opened and closed by the first discharge valve 171*a* (indicated by a broken line in the upper drawing of FIG. 4). The first valve seat seal section 154*a* is provided on the surface of the first discharge hole 151*a* which is away from the compression chamber 134 (namely, surface closer to the discharge chamber 137*a*, upper side in FIG. 4), and is configured to contact the first discharge valve 171*a* (see FIG. 3 as well as FIG. 4).

As shown in FIG. 4, the first convex portion 161*a* is provided on the tip end surface 160*a* of the piston 160 to correspond in position to the first discharge hole 151*a*. In the present embodiment, the first convex portion 161*a* has the truncated-cone shape. As described above, when the piston 160 is located at the top dead center, at least the tip end portion of the first convex portion 161*a* is located inside of the first discharge hole 151*a*. The size of the first discharge hole 151*a* is not particularly limited, and its hole diameter is suitably set depending on conditions. It is sufficient that at least the first convex portion 161*a* can be easily accommodated into the first discharge hole 151*a*.

In a state in which the first convex portion 161*a* is located inside of the first discharge hole 151*a*, a space (gap) formed between the outer peripheral surface (convex portion side surface 162*a*) of the first convex portion 161*a* and the inner peripheral surface (discharge hole inner peripheral surface 152*a*) of the first discharge hole 151*a* is a first discharge passage 172*a* (lower region indicated by a dotted-line in the lower drawing of FIG. 4). The refrigerant gas is discharged from the compression chamber 134 to the discharge chamber 137*a* through the first discharge passage 172*a*. When a spacing between the convex portion side surface 162*a* and the discharge hole inner peripheral surface 152*a* in the first discharge passage 172*a* is a passage spacing Cf, this passage spacings Cf in all of the discharge hole-convex portion relations is made uniform.

In the present embodiment, the first discharge hole 151*a* includes a portion having an opening area (transverse sectional area) increased in a direction from the compression chamber 134 toward the discharge chamber 137*a* (toward a discharge side, direction from the lower side toward the upper side in FIG. 4). In the example of FIG. 4, the first discharge hole 151*a* has the opening area which is decreased, and then increased, when viewed from the compression chamber 134. This opening shape is a bell-mouth section 153*a* (upper region indicated by a dotted-line in the lower drawing of FIG. 4). The bell-mouth section 153*a* has a circular-arc shape protruding toward the first discharge hole 151*a*, in the cross-sectional shape of the valve plate 150. The apex of the circular-arc is not located in the vicinity of the center of the thickness of the valve plate 150, and located close to the compression chamber 134.

The refrigerant gas discharged from the compression chamber 134 is in the high-pressure state. The bell-mouth section 153*a* provided in the first discharge hole 151*a* can reduce a passage resistance in the first discharge passage 172*a*, while the refrigerant gas is flowing through the first discharge passage 172*a*. The cross-sectional shape (e.g., radius of the circular-arc) of the bell-mouth section 153*a* is not particularly limited, but can be set as desired according to conditions.

Further, the cross-sectional shape of the first discharge hole 151*a* is not limited to the configuration including the bell-mouth section 153*a* of FIG. 4, so long as the first discharge hole 151*a* includes a portion having the opening area increased in a direction from the compression chamber 134 toward the discharge side. For example, the first discharge hole 151*a* may have the shape in which the opening area is gradually increased in the direction from the compression chamber 134 toward the discharge side, without including the portion having the opening area decreased and then increased.

Figure 5:
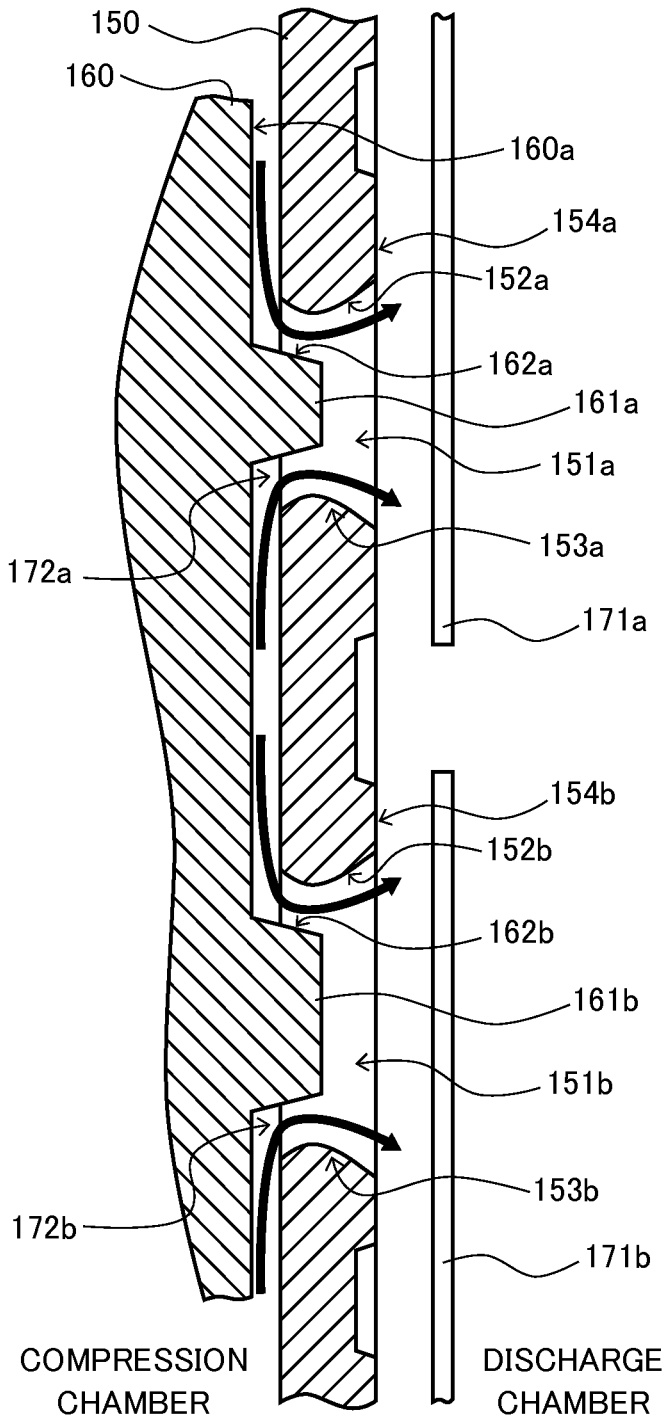
FIG. 5 is an enlarged cross-sectional view schematically showing a more specific correspondence between the valve plate and the piston of FIG. 2.

As shown in FIG. 5, in the present embodiment, the hole diameter of the second discharge hole 151*b* is set larger than the hole diameter of the first discharge hole 151*a*. In other words, in the present invention, the plurality of discharge holes are preferably different in hole diameter from each other. As can be clearly seen from the cross-sectional area of FIG. 5, the volume of the second convex portion 161*b* is set larger than the volume of the first convex portion 161*a*. In other words, in the present invention, the plurality of convex portions are different in volume from each other, rather than being uniform in volume.

Further, in the present embodiment, the volumes of the plurality of convex portions 161*a*, 161*b* are set so that the passage area (transverse sectional area between the convex portion side surface 162*a* and the discharge hole inner peripheral surface 152*a* defining the refrigerant gas passage) of the first discharge passage 172*a* in the first discharge hole-convex portion relation is different from the passage area (transverse sectional area between the convex portion side surface 162*b* and the discharge hole inner peripheral surface 152*b* defining the refrigerant gas passage) of the second discharge passage 172*b* in the second discharge hole-convex portion relation. In other words, the volumes of the plurality of convex portions 161*a*, 161*b* are made different from each other so that the passage areas of the plurality of discharge passages 172*a*, 172*b* are made different from each other. In the present embodiment, in addition, the passage spacings Cf of the plurality of discharge passages 172*a*, 172*b* are preferably made uniform. In other words, the passage spacing Cf of the first discharge passage 172*a* substantially matches (may approximate) the passage spacing Cf of the second discharge passage 172*b*, although they are different in volume from each other.

The function of the above discharge hole-convex portion relation will be specifically described in conjunction with the above-described operation of the sealed compressor. Hereinafter, for the sake of convenience, the compression stroke and the discharge stroke will be described as a series of stroke (the discharge stroke is included in the compression stroke in terms of the motion of the piston 160).

In the latter half of the compression stroke, as the volume of the compression chamber 134 decreases, the tip end surface 160*a* of the piston 160 becomes close to the valve plate 150 and the convex portions 161*a*, 161*b* become close to the corresponding discharge holes 151*a*, 151*b*, respectively. Then, with an increase in the pressure in the compression chamber 134, the discharge valves 171*a*, 171*b* are opened at the same time. Upon the opening of the discharge valves 171*a*, 171*b*, the refrigerant gas compressed in the compression chamber 134 is discharged into the discharge chamber 137*a* inside of the cylinder head 137 through the discharge passages 172*a*, 172*b*, as indicated by block arrows of FIG. 5 (see FIGS. 1 and 2 as well as FIG. 5).

At this time, in the first discharge hole-convex portion relation and the second discharge hole-convex portion relation, the passage spacing Cf of the first discharge passage 172*a* and the passage spacing Cf of the second discharge passage 172*b* are equal to each other or approximate each other, and the hole diameter of the second discharge hole 151*b* is larger than the hole diameter of the first discharge hole 151*a*. Therefore, the passage area of the second discharge passage 172*b* is larger than the passage area of the first discharge passage 172*a*. Correspondingly, the flow rate of the refrigerant gas discharged through the second discharge hole 151*b* is larger than the flow rate of the refrigerant gas discharged through the first discharge hole 151*a*, so that the second discharge valve 171*b* is opened to a degree larger than a degree to which the first discharge valve 171*a* is opened. This results in a difference between the timing when the first discharge valve 171*a* is closed, and the timing when the second discharge valve 171*b* is closed.

Since the second discharge valve 171*b* is opened to a larger degree, the first discharge valve 171*a* opened to a smaller degree collides against the first valve seat seal section 154*a* at a timing that is a little earlier than the timing when the second discharge valve 171*b* collides against the second valve seat seal section 154*b*. In this way, it becomes possible to prevent a situation in which the discharge valves 171*a*, 171*b* collide against the valve seat seal sections 154*a*, 154*b*, respectively at the same time. Therefore, the impact forces generated due to the collision of the discharge valves 171*a*, 171*b* against the valve seat seal sections 154*a*, 154*b*, respectively, can be reduced in magnitude. As a result, a noise generated when the discharge valves 171*a*, 171*b* are closed can be mitigated.

When the compression stroke progresses, the piston 160 reaches the top dead center. As shown in FIG. 5, the convex portions 161*a*, 161*b* move into the corresponding discharge holes 151*a*, 151*b*, respectively. Thereby, the refrigerant gas remaining in dead volumes inside of the discharge holes 151*a*, 151*b* is pushed away by the convex portions 161*a*, 161*b*, respectively, and discharged into the discharge chamber 137*a*. This makes it possible to prevent a situation in which the refrigerant gas remains inside of the discharge holes 151*a*, 151*b*. Therefore, during the suction stroke, the re-expansion of the remaining refrigerant gas can be suppressed, and the volumetric efficiency can be improved.

In the first discharge hole-convex portion relation and the second discharge hole-convex portion relation, the passage spacings Cf are made uniform to substantially conform to each other. For this reason, the flow rates of the refrigerant gas discharged from the discharge passages 172*a*, 172*b* are made uniform. If a great difference occurs between the flow rate of the refrigerant gas in the first discharge hole 151*a* and the flow rate of the refrigerant gas in the second discharge hole 151*b*, flow lines are significantly disordered, whereas if a difference between the flow rates is small, the disorder of the flow lines can be suppressed. In this way, since the flows of the refrigerant gas discharged from the discharge holes 151*a*, 151*b* are faired, the excess compression of the refrigerant gas can be lessened (excess compression loss can be reduced) during the discharge of the refrigerant gas.

The discharge holes 151*a*, 151*b* are provided with the above-described bell-mouth sections 153*a*, 153*b*, respectively. In this structure, the opening areas of the discharge holes 151*a*, 151*b* are gradually decreased and then gradually increased (each of the transverse sections of the discharge hole inner peripheral surfaces 152*a*, 152*b* becomes the circular-arc shape) in the direction from the compression chamber 134 toward the discharge side. The opening areas of the discharge holes 151*a*, 151*b* are smallest in locations closer to the compression chamber 134 rather than the location that is near the center of the valve plate 150.

In the above-described configuration, when the piston 160 is located in the vicinity of the top dead center, the refrigerant gas flows smoothly along the bell-mouth sections 153*a*, 153*b*, in the interior of the compression chamber 134, and rapid reduction of the passage areas of the discharge passages 172*a*, 172*b* can be prevented. This can lessen the fluctuation of the flow rates in localized regions of the discharge holes 151*a*, 151*b*. As a result, it becomes possible to suppress the excess compression loss in the discharge of the refrigerant gas, which would be caused by the disorder of the local flows inside of the discharge holes 151*a*, 151*b*.

In a case where the electric component 120 is inverter-driven at one of a plurality of operating frequencies, an increase in a noise can be suppressed even when the operating frequency is high and the reduction of the volumetric efficiency can be suppressed even when the operating frequency is low.

For example, in a case where the electric component 120 is driven at an operating frequency higher than a power supply frequency, the electric component 120 rotates at a high speed. Therefore, the impact forces generated when the discharge valves 171*a*, 171*b* are closed during the high-speed rotation are greater than those generated when the discharge valves 171*a*, 171*b* are closed during a low-speed rotation. In the present embodiment, since the volumes of the convex portions 161*a*, 161*b* are made different from each other, the flow rate of the refrigerant gas discharged from the first discharge passage 172*a* is different from the flow rate of the refrigerant gas discharged from the second discharge passage 172*b*. As described above, these differences cause the difference between the degrees to which the discharge valves 171*a*, 171*b* are opened, and hence the difference between the timings when the discharge valves 171*a*, 171*b* are closed. Since the discharge valves 171*a*, 171*b* do not collide against the valve seat seal sections 154*a*, 154*b*, respectively at the same time, the impact energy generated due to the collision of the discharge valves 171*a*, 171*b* against the valve seat seal sections 154*a*, 154*b* can be reduced in magnitude. As a result, a noise can be mitigated during the high-speed rotation.

In contrast, in a case where the electric component 120 is driven at an operating frequency equal to or lower than the power supply frequency, the electric component 120 rotates at a low speed. Therefore, the amount of the refrigerant gas circulated is relatively small. At this time, if the refrigerant gas remains inside of the discharge holes 151*a*, 151*b*, the effects of the re-expansion of the refrigerant gas which occurs during the suction stroke become significant. In the present embodiment, since the convex portions 161*a*, 161*b* provided on the tip end surface 160*a* of the piston 160 pushes away the refrigerant gas out of the discharge holes 151*a*, 151*b*, it becomes possible to prevent a situation in which the refrigerant gas remains inside of the discharge holes 151*a*, 151*b*. In this way, even in the case where the amount of the refrigerant gas circulated is relatively small during the low-speed rotation, the re-expansion of the remaining refrigerant gas can be suppressed during the suction stroke. As a result, the reduction of the volumetric efficiency can be suppressed.

Although in the present embodiment, the valve plate is formed with the two discharge holes, and the tip end surface of the piston is formed with two convex portions corresponding to the discharge holes, respectively, the present invention is not limited to this, and three or more discharge holes and three or more convex portions may be provided. Although in the present embodiment, the plurality of convex portions have the truncated-cone shape, the present invention is not limited to this, and the plurality of convex portions may have any shape other than the truncated-cone shape. Further, although in the present embodiment, each of the discharge holes includes a portion having a cross-sectional area increased from the discharge chamber toward the discharge side, the present invention is not limited to this, and each of the discharge holes may have a uniform cross-sectional area (cylindrical shape).

Although in the present embodiment, the volumes of the convex portions are made different from each other to make the passage areas of the discharge passages different from each other, the present invention is not limited to this. For example, the shapes of the convex portions may be made different from each other, the shapes of the discharge holes may be made different from each other, or a combination of these may be used, to make the passage areas of the discharge passage different from each other. In brief, in the present invention, the passage areas of the plurality of discharge passages may be made different from each other, in conjunction with at least one of the volumes of the plurality of convex portions, the shapes of the plurality of convex portions, and the shapes of the plurality of discharge holes.

Embodiment 2

In Embodiment 2, an exemplary refrigeration device including the sealed compressor 100 of Embodiment 1 will be described specifically with reference to FIG. 6.

The sealed compressor 100 of the present invention can be suitably incorporated into a refrigeration cycle or various devices (refrigeration devices) having a configuration similar to that of the refrigeration cycle. Specifically, for example, the devices may be a refrigerator (refrigerator for household use or refrigerator for business purpose), an ice making machine, a show case, a dehumidifier, a heat pump type hot water supply device, a heat pump type laundry/drying machine, an automatic vending machine, an air conditioner, an air compressor, etc. However, these are merely exemplary. In the present embodiment, the basic configuration of a refrigerator 200 (article storage device) of FIG. 6, as an exemplary device into which of the sealed compressor 100 of the present invention is incorporated, will be specifically described.

Figure 6:
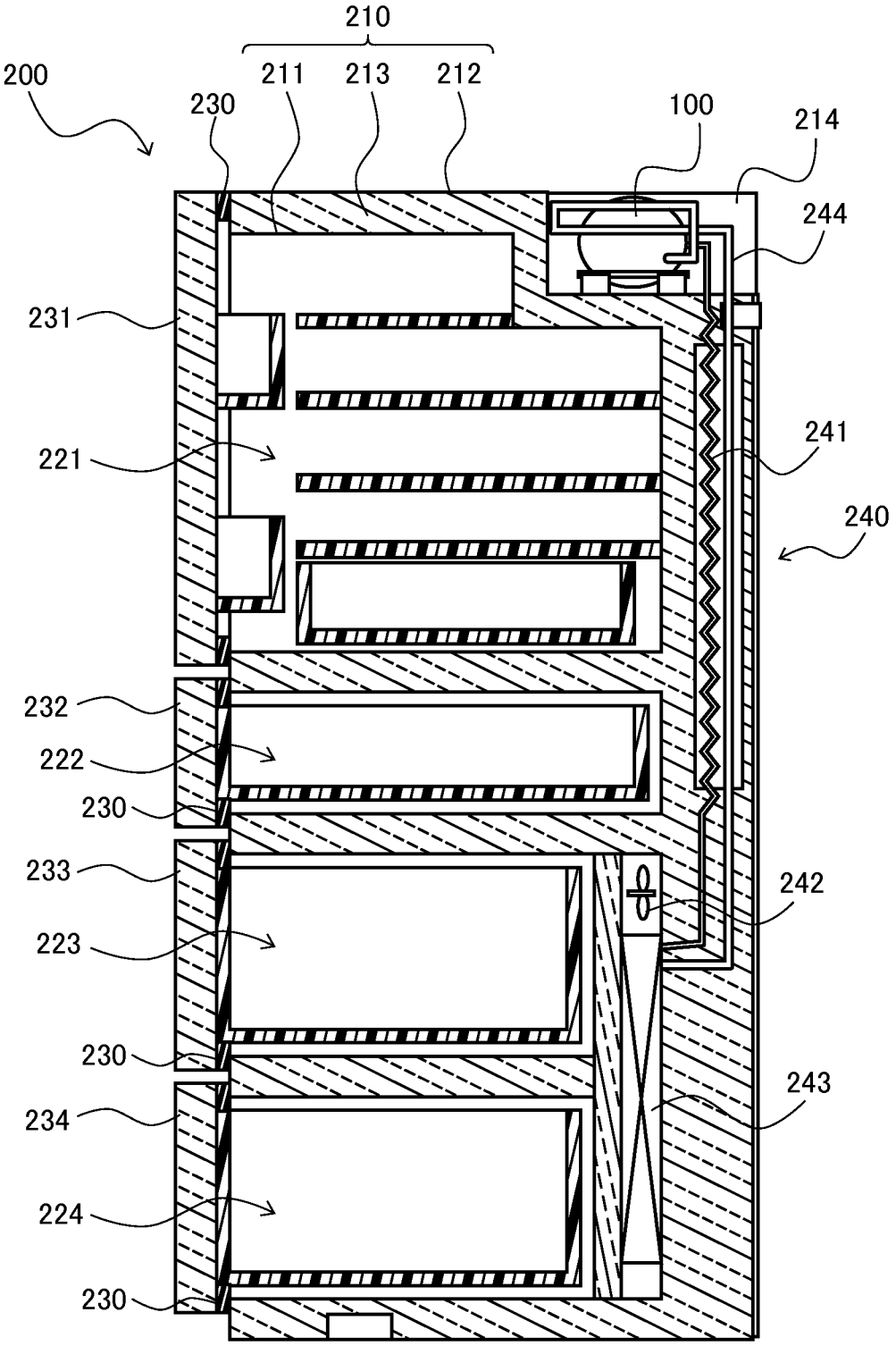
FIG. 6 is a cross-sectional view schematically showing the configuration of a refrigerator which is an exemplary refrigeration device according to Embodiment 2 of the present invention.
Figure 7:
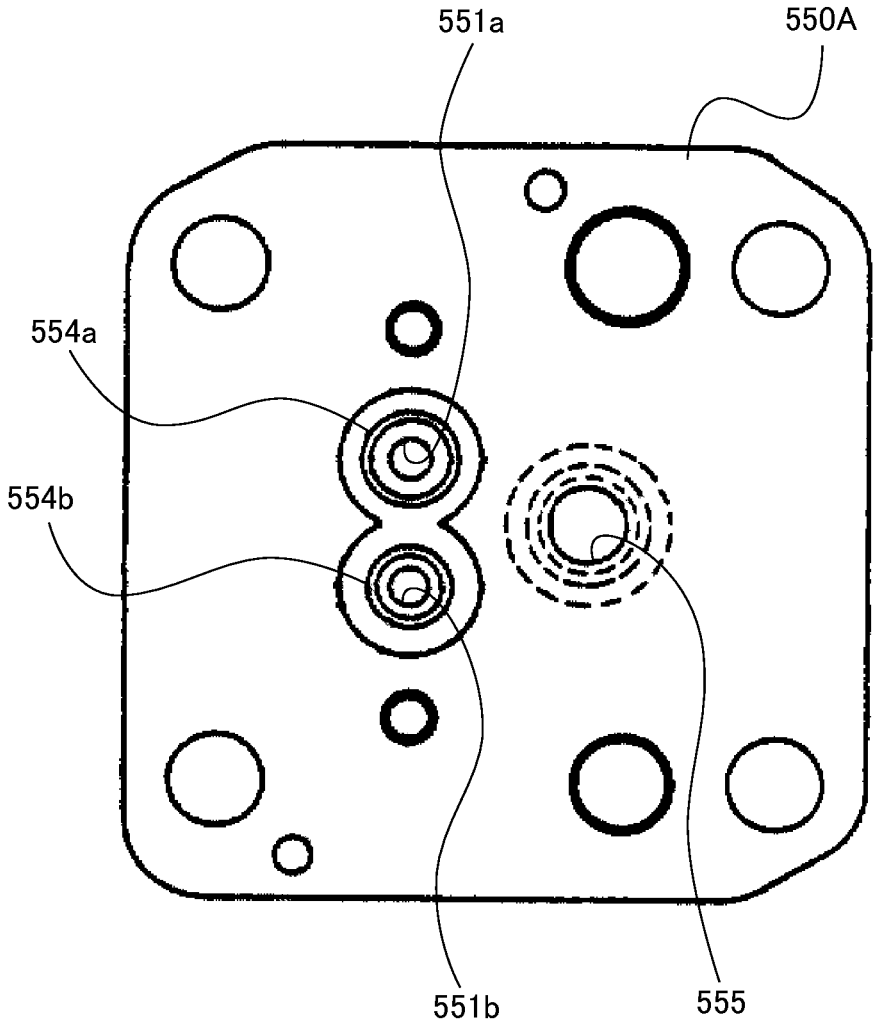
FIG. 7 is a plan view showing the configuration of a valve plate included in a conventional sealed compressor.
Figure 8:
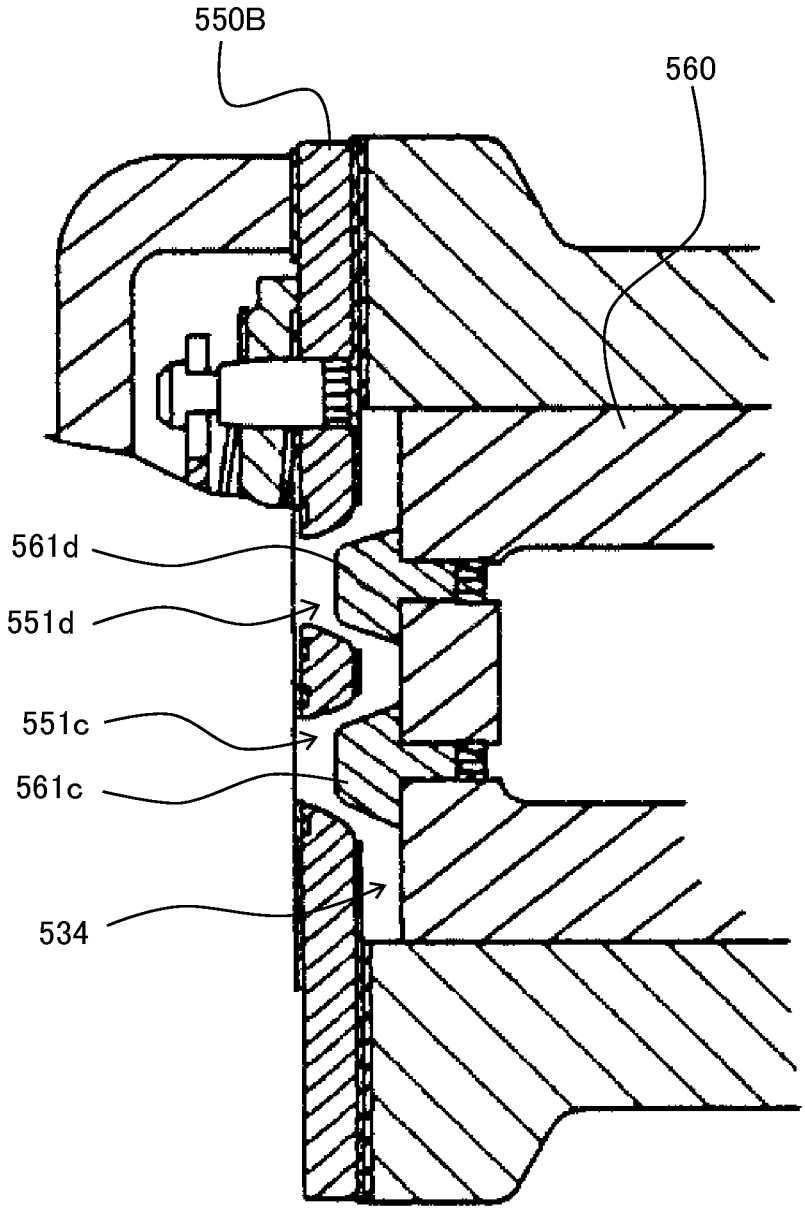
FIG. 8 is a cross-sectional view showing the major components which are a valve plate and a piston included in another conventional sealed compressor.

The refrigerator 200 of FIG. 6 includes a heat insulating box 210 as a body and a refrigerant circuit 240. The heat insulating box 210 comprises a heat insulating wall formed by filling a heat insulating member 213 into an inner space formed between an inner box 211 and an outer box 212. The inner box 211 defines the inner surface of the heat insulating box 210 and is manufactured by, for example, vacuum-molding of a resin such as ABS. The outer box 212 is manufactured by processing a metal such as pre-coating steel in a predetermined shape.

The heat insulating member 213 comprises a foam material such as hard urethane foam, phenolic foam, or styrene foam. The heat insulating member 213 is formed by filling the raw material of the foam material into the space formed between the inner box 211 and the outer box 212, foaming and packing the material. A foaming agent is not particularly limited. As the foaming agent, for example, cyclopentane which is a hydrocarbon-based solvent is preferably used. As the heat insulating member 213, a vacuum heat insulating material may be used along with the foam material, or the heat insulating member 213 may consist of the vacuum heat insulating material.

The foam material may be unitarily filled into the inner space formed between the inner box 211 and the outer box 212. As will be described later, the heat insulating box 210 is divided into a plurality of heat insulating compartments. Filling the foam material unitarily inside of the heat insulating walls defining the heat insulating compartments can reduce cost and improve heat insulating performance. In the case where the foam material is unitarily filled into the inner space formed between the inner box 211 and the outer box 212, for example, heat insulating performance which is about twice as high as that in a case where a heat insulating member such as styrol foam is accommodated in the inner space, can be obtained. In addition, the heat insulating wall as the partition wall can be thinned. This makes it possible to increase the storage volume of the refrigerator 200.

In the present embodiment, the heat insulating box 210 is divided into the plurality of heat insulating compartments. The upper heat insulating compartments are opened and closed by a rotatable door 231, while the lower heat insulating compartments are drawn forward and backward to be opened and closed. In the present embodiment, the heat insulating box 210 is divided into five heat insulating compartments in total, which are a storage room 221, a storage room 222, a storage room 223, and a storage room 224, from the upper to the lower. The storage rooms 221 to 224 have front openings, respectively, and are openably closed by the door member.

The storage room 221 is a chillroom located at an uppermost side of the heat insulating box 210, and its internal temperature is set to a temperature at which articles of food are not frozen (e.g., in the range of 1 degrees C. to 5 degrees C.) to chill and preserve the articles of food. The front opening of the storage room 221 is openably closed by the rotatable door 231 via a gasket 230.

The storage room 222 is located under the storage room 221, and includes two heat insulating compartments which are a switching room and an ice making room. Although the storage room 222 is schematically shown as a single heat insulating compartment in FIG. 6, the storage room 222 as the switching room and the storage room 222 as the ice making room are actually arranged side by side.

The switching room is the heat insulating compartment, the internal temperature of which can be changed by user setting. The internal temperature of the switching room may be suitably set within the range of a freezing room temperature zone, a chilling room temperature zone, and a vegetable room temperature zone. The ice making room is the heat insulating compartment including an automated ice making device to automatically make and preserve the ice. The internal temperature of the ice making room may fall into the freezing temperature zone. To preserve the ice, the internal temperature of the ice making room can be set to fall into a temperature zone (e.g., within the range of −18 degrees C. to −10 degrees C.) which is higher than a general freezing temperature zone (e.g., within the range of −22 degrees C.

to −18 degrees C.). The front opening of the storage room 222 is openably closed by a drawing door 232 via a gasket 230.

The storage room 223 is a refrigerating room located under the storage room 222 and used as a vegetable room for primarily storing vegetables. In most cases, the internal temperature of the storage room 223 is set to fall into a temperature zone (e.g., within the range of 2 degrees C. to 7 degrees C.) which is equal to or a little higher than that of the storage room 221. The storage room 223 can keep the freshness of vegetables for a long period of time, under the condition of a lower temperature set at which the vegetables are not frozen. The front opening of the storage room 223 is openably closed by the drawing door 233 via the gasket 230.

The storage room 224 is a freezing room located under the storage room 223 and at a lowermost side of the heat insulating box 210. The internal temperature of the storage room 224 may be set to fall into a general freezing temperature zone (e.g., within the range of −22 degrees C. to −18 degrees C.). To improve the frozen/preserved state, the internal temperature of the storage room 224 may be set to fall into a lower freezing temperature zone (e.g., −25 degrees C. or −30 degrees C.). The front opening of the storage room 224 is openably closed by the drawing door 233 via the gasket 230.

In the present embodiment, as shown in FIG. 6, a recess 214 is provided at the rear side of the top surface of the heat insulating box 210. The compressor 100 of Embodiment 1 and the like are accommodated into the recess 214 such that they are elastically supported.

The refrigerant circuit 240 includes the compressor 100 of Embodiment 1, a condenser (not shown), a capillary tube 241, a drier (not shown), a cooling fan 242, an evaporator 243, etc. As described above, the compressor 100 is accommodated into the recess 214 at the rear side of the upper portion of the heat insulating box 210. The condenser is attached on the heat insulating wall as the side surface of the heat insulating box 210, or the like. The capillary tube 241 is provided at the heat insulating wall as the back surface of the heat insulating box 210. The cooling fan 242 is attached on the back surface of the storage room 223. The evaporator 243 is provided in the vicinity of the cooling fan 242 (on the back surface of the storage room 223 and the back surface of the storage room 224).

The compressor 100, the condenser, the capillary tube 241, the drier, the cooling fan 242, and the evaporator 243 are annularly connected to each other by use of a pipe 244, thus constituting the refrigerant circuit 240. Of the pipe 244, a portion connected to the suction side of the compressor 100 is the suction pipe 103, and a portion connected to the discharge side of the compressor 100 is the exit pipe 105. This refrigerant circuit 240 is an example of the refrigeration cycle incorporating the compressor 100 of the present invention. The capillary tube 241 is a pressure reducing device, while the drier serves to remove a moisture.

The operation of the refrigerant circuit 240 configured as described above will be specifically described. The refrigerator 200 includes a temperature sensor (not shown) and a control board (not shown). The control board starts or stops a cooling operation, depending on the internal temperature detected by the temperature sensor. When the cooling operation is started, the compressor 100 performs the above-described predetermined compression operation. In the compression operation, the refrigerant gas in high-temperature and high-pressure states, which is discharged from the compressor 100, radiates heat and is condensed into water, while flowing through the condenser (not shown). Further, the pressure of the refrigerant gas is reduced by the capillary tube 241. The resulting liquid refrigerant in low-temperature and low-pressure states reaches the evaporator 243.

According to the operation of the cooling fan 242, heat exchange between air in the interior of the refrigerator 200 and the liquid refrigerant flowing through the interior of the evaporator 243 occurs. Cold air in a low-temperature state, resulting from the heat exchange, is distributed to the heat insulating compartments via dampers (not shown) and the like, and thus the interiors of the storage rooms 221 to 224 are cooled. As a result of the heat exchange, the liquid refrigerant is evaporated into the refrigerant gas and suctioned into the compressor 100 via the pipe 244.

In the refrigerator 200 configured as described above, the refrigerant circuit 240 includes the compressor 100 of Embodiment 1. In the compressor 100, when the piston 160 reaches the top dead center and the refrigerant gas is discharged through the discharge holes 151*a*, 151*b*, during the compression stroke, the convex portions 161*a*, 161*b* provided on the tip end surface 160*a* of the piston 160 push away the refrigerant gas out of the discharge holes 151*a*, 151*b*. In this way, the amount of the refrigerant gas remaining in the interior of the compression chamber 134 can be reduced. As a result, during the suction stroke, the re-expansion of the remaining refrigerant gas can be suppressed, and thus the volumetric efficiency can be improved.

Since the volumes of the convex portions 161*a*, 161*b* are made different from each other in the compressor 100, the passage area of the first discharge passage 172*a* defined by the discharge hole inner peripheral surface 152*a* and the convex portion side surface 162*a* is different from the passage area of the second discharge passage 172*b* defined by the discharge hole inner peripheral surface 152*b* and the convex portion side surface 162*b*. This causes a difference between the degree to which the first discharge valve 171*a* is opened and the degree to which the second discharge valve 171*b* is opened, and hence a difference between the timing when the first discharge valve 171*a* is closed and the timing when the second discharge valve 171*b* is closed. Since the discharge valves 171*a*, 171*b* do not collide against the valve seat seal sections 154*a*, 154*b*, respectively, at the same time, the impact forces generated due to the collision of the discharge valves 171*a*, 171*b* against the valve seat seal sections 154*a*, 154*b*, respectively, can be reduced in magnitude. As a result, a noise generated when the discharge valves 171*a*, 171*b* are closed can be mitigated.

Since the volumetric efficiency of the compressor 100 can be improved, electric power consumption in the refrigerator 200 can be reduced, and energy saving can be realized. In addition, since the noise generated in the compressor 100 can be mitigated, a noise generated in the refrigerator 200 can also be mitigated. As a result, in accordance with the present embodiment, it becomes possible to realize an article storage device which can reduce electric power consumption and mitigate a noise.

Numerous improvements and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

INDUSTRIAL APPLICABILITY

The present invention can increase the efficiency of a sealed compressor and mitigate a noise of the sealed compressor. Therefore, the present invention is suitably used in the fields of the sealed compressor incorporated into a refrigeration cycle. For example, the present invention can be widely suitably used in the fields of refrigeration devices including sealed compressors, such as refrigeration devices for household uses such as electric freezers/refrigerators or air conditioners, or refrigeration devices for business purposes such as dehumidifiers, show cases for business purposes or automatic vending machines, etc.

REFERENCE SIGNS LIST

100 sealed compressor
101 sealed container
120 electric component
130 compression component
131 cylinder block
132 cylinder
134 compression chamber
150 valve plate
151*a* first discharge hole
151*b* second discharge hole
152*a*, 152*b* discharge hole inner peripheral surface
153*a*, 153*b* bell-mouth section
154*a* first valve seat seal section
154*b* second valve seat seal section
155 suction hole
160 piston
160*a* tip end surface
161*a* first convex portion
161*b* second convex portion
162*a*, 162*b* convex portion side surface (outer peripheral surface)
171*a* first discharge valve
171*b* second discharge valve
172*a* first discharge passage
172*b* second discharge passage
Cf passage spacing

The invention claimed is:

1. A sealed compressor comprising:

a sealed container having a sealed space inside thereof;

an electric component accommodated in the sealed container; and a compression component accommodated in the sealed container and driven by the electric component to compress a refrigerant gas, wherein the compression component includes:

a cylinder block formed with a compression chamber inside thereof;

a piston reciprocatingly inserted into the compression chamber through one end of the cylinder block; and a valve plate which closes the other end of the cylinder block, wherein the valve plate has a suction hole through which the refrigerant gas is suctioned into the compression chamber, and a plurality of discharge holes through which the refrigerant gas is discharged from an interior of the compression chamber, the valve plate being provided with a plurality of discharge valves which open and close the plurality of discharge holes, respectively, each discharge hole of the plurality of discharge holes having a different diameter, wherein the discharge holes have an opening shape which is a bell mouth section configured such that opening areas of the discharge holes are gradually decreased and then gradually increased in the direction from the compression chamber toward a discharge side of the valve plate, and the opening areas of the discharge holes are smallest in locations nearer to the compression chamber than locations near a center of the valve plate, wherein the piston is provided with a plurality of convex portions on a tip end surface thereof, at least tip end portions of the plurality of convex portions being located inside of the plurality of discharge holes, respectively, in a state in which the piston is located at a top dead center, wherein the convex portions are sized relative to the discharge holes such that when a plurality of discharge passages of the refrigerant gas are defined as spaces formed between outer peripheral surfaces of the plurality of convex portions and inner peripheral surfaces of the plurality of discharge holes, respectively, in a state in which the plurality of convex portions are located inside of the plurality of discharge holes, respectively, and when passage spacings of the plurality of discharge passages are defined as a distance between the outer peripheral surfaces of the plurality of convex portions and the inner peripheral surfaces of the plurality of discharge holes at the tip end portions of the plurality of convex portions, and passage areas are defined as a transverse sectional area between the outer peripheral surfaces of the plurality of convex portions and the inner peripheral surfaces of the plurality of discharge holes, each of the plurality of discharge passages has the same non-zero passage spacing, and the passage areas of the plurality of discharge passages are different from each other.

2. The sealed compressor according to claim 1, wherein the passage areas of the plurality of discharge passages are made different from each other, by making at least one of volumes of the plurality of convex portions, shapes of the plurality of convex portions, and sizes of the plurality of discharge holes, different from each other.

3. The sealed compressor according to claim 1, wherein the electric component is inverter-driven at one of a plurality of operating frequencies.

4. A refrigeration device comprising:

the sealed compressor as recited in claim 1.

* * * * *